US009369791B2

(12) United States Patent
Tanaka

(10) Patent No.: US 9,369,791 B2
(45) Date of Patent: Jun. 14, 2016

(54) EARPHONE DEVICE

(71) Applicant: Kenta Tanaka, Fujisawa (JP)

(72) Inventor: Kenta Tanaka, Fujisawa (JP)

( * ) Notice: Subject to any disclaimer, the term of this patent is extended or adjusted under 35 U.S.C. 154(b) by 0 days.

(21) Appl. No.: 14/402,861

(22) PCT Filed: Oct. 16, 2012

(86) PCT No.: PCT/JP2012/076662
§ 371 (c)(1),
(2) Date: Nov. 21, 2014

(87) PCT Pub. No.: WO2014/061092
PCT Pub. Date: Apr. 24, 2014

(65) Prior Publication Data

US 2015/0110329 A1 Apr. 23, 2015

(51) Int. Cl.

| | |
|---|---|
| ***H04R 25/00*** | (2006.01) |
| ***H04R 1/10*** | (2006.01) |
| ***H04R 1/28*** | (2006.01) |

(52) U.S. Cl.
CPC ..... *H04R 1/10* (2013.01); *H04R 1/1016* (2013.01); *H04R 1/2896* (2013.01); *H04R 1/1058* (2013.01)

(58) Field of Classification Search
CPC ..... H04R 1/1075; H04R 1/24; H04R 1/403; H04R 25/405
USPC ..... 381/370, 380, 376, 345, 182
See application file for complete search history.

(56) References Cited

U.S. PATENT DOCUMENTS 7,499,555 B1 * 3/2009 Isvan ..... H04R 1/1075 381/182
2012/0070022 A1 3/2012 Saiki

FOREIGN PATENT DOCUMENTS

| | | | |
|---|---|---|---|
| JP | 62-39394 | U | 3/1987 |
| JP | 2002-247687 | A | 8/2002 |
| JP | 2010-283643 | A | 12/2010 |
| WO | 2004/052050 | A1 | 6/2004 |
| WO | 2011/114688 | A1 | 9/2011 |

OTHER PUBLICATIONS

Notification of Transmittal of Translation of the International Preliminary Report on Patentability (Form PCT/IB338) of Application No. PCT/JP2012/076662 mailed Apr. 30, 2015, with PCT/IB/373 and PCT/ISA/237 (English translation) (5 pages).
International Search Report dated Jan. 8, 2013 issued in corresponding application PCT/JP2012/076662.
Supplementary European Search Report dated Feb. 8, 2016, issued in counterpart European Patent Application No. 12 886 887.4, (3 pages).

* cited by examiner

*Primary Examiner* — Sunita Joshi
(74) *Attorney, Agent, or Firm* — Westerman, Hattori, Daniels & Adrian, LLP

(57) ABSTRACT

A first speaker unit A has a first yoke 31, a first vibrating film 33 supported by the first yoke 31, and a first driving part 35 supported in the first yoke 31, for driving the first vibrating film 33 by an applied voice signal, and a second speaker unit B has a second yoke 49, a second vibrating film 51 supported by the second yoke 49, and a second driving part supported in the second yoke 49, for driving the second driving film 51 by the voice signal, wherein the first speaker unit A and the second speaker unit B are integrally formed with a space between the first and second vibrating films 33 and 53 set in an airtight state, and the first and second vibrating films 33 and 53 are driven so as to be displaced and vibrated in the same direction.

14 Claims, 7 Drawing Sheets waveform of first speaker unit waveform of second speaker composite waveform

EARPHONE DEVICE

TECHNICAL FIELD

The present invention relates to an earphone device, and relates to an improvement of the earphone device that can be used as an earphone or a headphone which is worn in an ear of a user, and further a large speaker.

DESCRIPTION OF RELATED ART

Conventionally, for example a structure shown in FIG. 5 is known as the earphone device worn in the ear of the user. In this structure, one of the end faces of a cylindrical magnet 5 is fixed in a cup-shaped yoke 3 disposed in a case body 1; a thin vibrating film 7 is fixed to an end of the yoke 3 to thereby cover the opening part of the yoke 3 so that the vibrating film 7 and the other end face of the magnet 5 are faced each other with a space between them; and a cylindrical coil 9 fixed to the vibrating film 7, is inserted into an outer periphery of the magnet 5, with a slight space between them.

In FIG. 5, the case body 1 is composed of a funnel-shaped base part 1*a* and a front cover 1*b* covering a top end (right side in the figure) of the base part 1*a*. The yoke 3 is supported the case body 1 by fixing the top end of the opening part to the inside of the front cover 1*b*.

Reference number 11 in FIG. 5 indicates a plurality of sound holes formed on a front cover 1*b* in penetrating manners on a front face of the vibrating film 7, and reference number 13 indicates a cable led out to outside. The cable 13 has a knot 13*a* in the base part 1*a*.

In this earphone device, a driving part 15 for vibrating the vibrating film 7 is formed by the magnet 5 and the coil 9, and a voice signal is applied to the coil 9 from outside through the cable 13, so that the vibrating film 7 is vibrated by an operation of the driving part 15 to thereby emit a sound, and the emitted sound is transmitted to the outside from the sound holes 11 on the front face of the vibrating film 7.

Then, such a kind of earphone device is formed into an external auditory canal inserting type and is put to practical use as a product actually.

The structure of the external auditory canal inserting type earphone device as shown in FIG. 6, is obtained by slightly modifying the structure of FIG. 5 for example, and the earphone device with this structure is used in such a way that the case body 1 is inserted into a cavity of concha 23 surrounded by tragus 17, antitragus 19, and concha 21 of a user so that the vibrating film 7 is approached to the cavity of concha 21, and a sound transmitting cylindrical body 27 protruded from the case body 1, is inserted into an external auditory canal 25 which extends to an eardrum (not shown) from the cavity of concha 23.

A coaxial shape (see FIG. 6) with a central axis of the vibrating film 7 and a central axis of the sound transmitting cylindrical body 27 aligned to each other, and a non-coaxial shape (see FIG. 7) with the central axis of the sound transmitting cylindrical body 27 set obliquely to the central axis of the vibrating film 7, can be given as actual products. FIG. 6 and FIG. 7 show a state that the earphone device is worn on a left ear.

Note that reference number 29 in FIG. 6 and FIG. 7 indicates a flexible ear chip (ear pat, ear piece) fit to an outer periphery of the sound transmitting cylindrical body 27, which is elastically abutted on an inner wall of the external auditory canal 25.

Incidentally, Japanese Patent Laid Open Publication No. 2010-283643 (patent document 1) discloses the earphone device as a publicly-known example.

PRIOR ART DOCUMENT

Patent Document

Patent Document 1:

Japanese Patent Laid Open Publication No. 2010-283643

DISCLOSURE OF THE INVENTION

Problem to be Solved by the Invention

However, above-mentioned any one of the earphone devices has a structure composed of the yoke 3, the magnet 5, the vibrating film 7, and the coil 9 arranged in the case body 1 as a set. Probably this structure has a structural limit in responding to a request of a user such as a higher quality and higher output of a driving sound.

Therefore, as a result of strenuous efforts by inventors of the present invention regarding various structures, it is found that the higher quality and higher output of the driving sound can be achieved by combining structures of a plurality of speakers. Thus, the present invention is completed.

In order to solve the above-mentioned subject, the present invention is provided, and an object of the present invention is to provide an earphone device capable of realizing the higher quality and higher output of the driving sound.

Means for Solving the Problem

In order to solve the above-mentioned problem, an earphone device of the present invention includes:

a first speaker unit having a first yoke, a first vibrating film supported by the first yoke, and a first driving part supported in the first yoke, for driving the first vibrating film by an applied voice signal; and a second speaker unit having a second yoke, a second vibrating film supported by the second yoke, and a second driving part supported in the second yoke, for driving the second vibrating film by the applied voice signal.

Wherein the first and second speaker units are integrally disposed to face each other, with a space between the first and second vibrating films set in an airtight state, and the first and second vibrating films are driven so as to be displaced and vibrated in the same direction, and sound holes are formed in the first speaker unit or the second speaker unit, for transmitting the sound emitted by the vibration of the first and second vibrating films to the outside.

According to another aspect of the earphone device of the present invention, the first and second speaker units are formed in the same shape respectively.

According to another aspect of the earphone device of the present invention, the first and second speaker units are mutually disposed in a coaxial state.

According to another aspect of the earphone device of the present invention, open ends of the first and second yokes are connected by a ring-shaped connecting member with a slight space between them, with a space between the first and second vibrating films set in an airtight state.

According to another aspect of the earphone device of the present invention, the first and second driving parts are configured to drive the first and second vibrating films by the same sound signal with phases reverse to each other.

According to another aspect of the earphone device of the present invention, in the first speaker unit, the first yoke is formed into a magnetic cup-shape, and a first magnet is fixed in the first yoke, the first vibrating film is fixed to the first yoke with a space between the open end of the first yoke and the first magnet to cover an opening part, and a cylindrical first coil fixed to the first vibrating film is inserted into an outer periphery of the first magnet, with a slight space between them.

According to another aspect of the earphone device of the present invention, in the second speaker unit, the second yoke is formed into a magnetic cup-shape, and a second magnet is fixed in the second yoke, the second vibrating film is fixed to the second yoke with a space between the open end of the second yoke and the second magnet to cover an opening part, and a cylindrical first coil fixed to the second vibrating film is inserted into an outer periphery of the second magnet, with a slight space between them.

According to another aspect of the earphone device of the present invention, the first magnet of the first speaker unit and the second magnet of the second speaker unit are faced each other in the same polarity.

According to another aspect of the earphone device of the present invention, small holes are formed on at least one of the first and second vibrating films.

According to the earphone device of the present invention, the first and second speaker units are disposed to face each other, with a space between the first and second vibrating films set in an airtight state, and the first and second vibrating films are driven so as to be displaced and vibrated in the same direction. Therefore, a driving sound with small distortion and high quality can be obtained.

Further, according to the earphone device of the present invention, the first and second speaker units are formed in the same shape respectively. Therefore both characteristics are obtained together, and further higher quality of the driving sound can be realized.

Further, according to the earphone device of the present invention, the first and second speaker units are mutually disposed in a coaxial state. Therefore both characteristics are obtained together, and further higher quality of the driving sound can be realized.

Further, according to the earphone device of the present invention, open ends of the first and second yokes are connected by a ring-shaped connecting member with a slight space between them, and in this structure, the first and second speaker units can share a common speaker unit. Therefore an assembly can be simplified without increasing a cost.

Further, according to the earphone device of the present invention, the first and second vibrating films are driven so as to be displaced and vibrated in the same direction, only by a connection state of the voice signal to the first and second driving parts of the first and second speaker units. Therefore the structure can be simplified.

According to the earphone device of the present invention, when the small holes are formed on at least one of the first and second vibrating films, fine adjustment of the frequency characteristics of the first and second speaker units is possible in a range of not significantly affecting the frequency characteristics.

DETAILED DESCRIPTION OF THE INVENTION

Embodiments of an earphone device according to the present invention will be described hereafter, with reference to the drawings.

Figure 1:
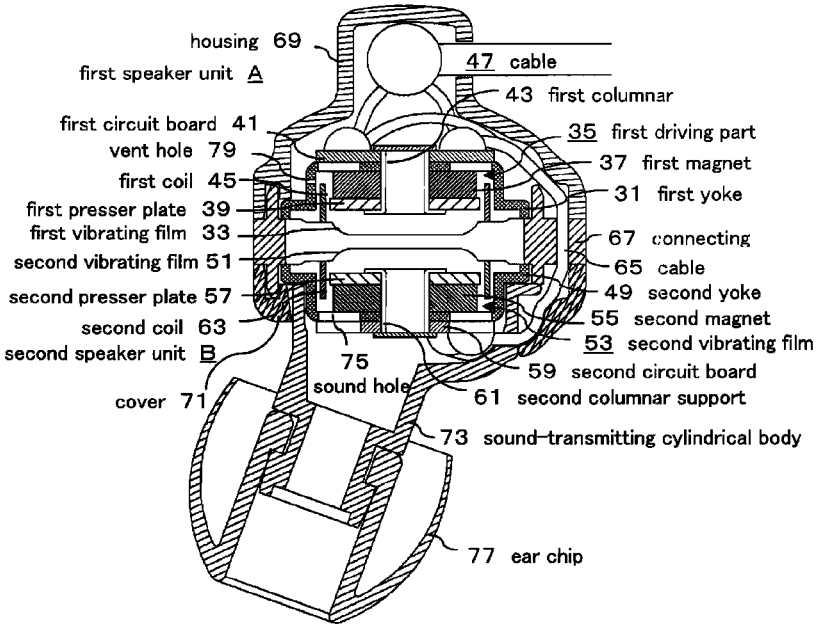
FIG. 1 is a cross-sectional view showing an embodiment of an earphone device according to the present invention.

FIG. 1 is a cross-sectional view showing an embodiment of an earphone device according to the present invention.

In FIG. 1, the earphone device of the present invention is configured so that a first speaker unit A and a second speaker unit B having approximately the same shape as the first speaker unit A, are integrally and coaxially disposed to face each other.

Figure 2:
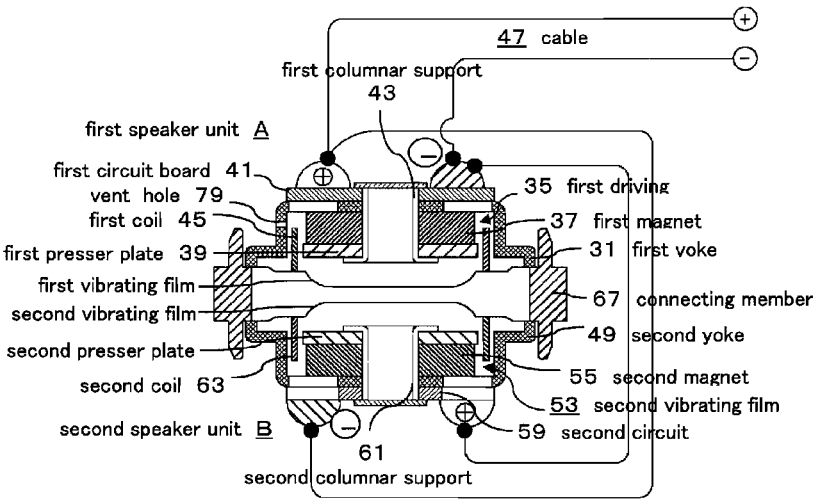
FIG. 2 is a schematic sectional view of an essential part of the earphone device of FIG. 1.

As shown in FIG. 2, the first speaker unit A has a first yoke 31, a first vibrating film 33 supported by the first yoke 31, and a first driving part 35 supported in the first yoke 31, for driving the first vibrating film 33 by an applied voice signal.

The first yoke 31 is formed into a magnetic cup-shape. One of the end faces of the cylindrical first magnet 37 is superposed on an inner bottom part of the first yoke 31, and a ring-shaped first presser plate 39 made of a magnetic material is superposed on the other end face of the first magnet 37. A first circuit board 41 is superposed on an outer bottom part of the first yoke 31.

A first columnar support 43 is penetrated and inserted into each central portion of an inner bottom part of the first yoke 31, the first magnet 37, the first presser plate 39, and the first circuit board 41, and caulked so that both ends of the first columnar support 43 are expanded. Thus, the first magnet 37 and the first presser plate 39 are fixed in the first yoke 31, and the first circuit board 41 is fixed to the outer bottom part of the first yoke 31.

The first magnet 37 is magnetized in N-pole at an open end side of the first yoke 31, and the first presser plate 39 is also magnetized in N-pole.

On the other end face side of the first magnet 37, namely on the open end side of the first yoke 31, a thin first vibrating film 33 is fixed to the end of first yoke 31 so that the thin first vibrating film 33 is faced with the first magnet 37 with a space between them, and an opening part of the first yoke 31 is covered with the first vibrating film 31.

The cylindrical first coil 45 is fixed to the first vibrating film 33 at one of the end face sides thereof, and inserted into the outer periphery of the first magnet 37 with a slight space between them, to thereby form the abovementioned first driving part 35.

The first circuit board 41 has a cable 47 connected thereto for supplying a voice signal from outside, so that the voice signal is supplied to the first coil 45 through a lead wire not shown arranged on the first yoke 31 and the first vibrating film 33.

The second speaker unit B has a second yoke 49, a second vibrating film 51 supported by the second yoke 49, and a second driving part 53 supported in the second yoke 49, for driving the second vibrating film 51 by an applied voice signal.

The second yoke 49 is formed into a magnetic cup-shape. One of the end faces of the cylindrical second magnet 55 is superposed on an inner bottom part of the second yoke 49, and a ring-shaped second presser plate 57 made of a magnetic material is superposed on the other end face of the second magnet 55. A second circuit board 59 is superposed on an outer bottom part of the second yoke 49.

A second columnar support 61 is penetrated and inserted into each central portion of an inner bottom part of the second yoke 49, the second magnet 55, the second presser plate 57, and the second circuit board 59, and caulked so that both ends of the second columnar support 61 are expanded. Thus, the second magnet 55 and the second presser plate 57 are fixed in the second yoke 49, and the second circuit board 59 is fixed to the outer bottom part of the second yoke 49.

The second magnet 55 is magnetized in N-pole at an open end side of the second yoke 49, in the same pole as the end side of the first magnet 37, and the second presser plate 57 is also magnetized in N-pole.

On the other end face side of the second magnet 55, namely on the open end side of the second yoke 49, a thin second vibrating film 51 is fixed to the end of second yoke 49 so that the thin second vibrating film 51 is faced with the second magnet 55 with a space between them, and an opening part of the second yoke 49 is covered with the second vibrating film 51.

The cylindrical second coil 63 is fixed to the second vibrating film 51 at one of the end face sides, and inserted into the outer periphery of the second magnet 55 with a slight space between them, to thereby form the abovementioned second driving part 53.

The second circuit board 59 has a cable 65 connected thereto for supplying a voice signal from the first circuit board 41 (see FIG. 1), so that the voice signal is supplied to the second coil 63 through a lead wire not shown arranged on the second yoke 49 and the second vibrating film 51.

The second coil 63 is connected to the cable 61 so that the voice signal is applied, with a phase reverse to the first coil 43.

The first and second speaker units A and B are integrally supported and fixed by a flat or ring-shaped connecting member 67 so that the first and second vibrating films 33 and 51 are faced each other with a slight space between them. The space between the first and second vibrating films 33 and 51 is set in an airtight state.

In FIG. 1 again, a cup-shaped synthetic resin housing 69 is put on the first speaker unit A so as to cover the first yoke 31, the first circuit board 41, and the cable 47, and fixed to the connecting member 67. The cable 47 is led out from the housing 69.

Also, a flat and ring-shaped synthetic resin cover 71 is put on the second speaker unit B so as to cover the second yoke 49, the second circuit board 59, and the cable 65, and fixed to the connecting member 67, with the connecting member 67 placed between them.

These housing 69, connecting member 67, and cover 71 are integrally fixed by an adhesive agent (not shown), etc., so that the first and second speaker units A and B supported by the connecting member 67 are wrapped and protected by the housing 69 and the cover 71.

A synthetic resin sound-transmitting cylindrical body 73 is fixed to the cover 71 so as to protrude obliquely to the central axis of the second speaker unit B. The sound emitted by vibration of the first and second vibrating films 33 and 51 is transmitted to outside from the sound-transmitting cylindrical body 73.

A sound hole 75 is formed on a bottom part of the second speaker unit B, for transmitting the emitted driving sound to the sound-transmitting cylindrical body 73.

An ear chip 77 made of a flexible synthetic resin is fit to an outer periphery of the end side of the sound transmitting cylindrical body 73, so as to be removed.

Reference number 79 in FIG. 1 indicates a very small vent hole formed in the first speaker unit A for securing a smooth displacement of vibration of the first and second vibrating films 33 and 51.

In such an earphone device, first and second driving parts 35 and 53 emit a sound by vibrating the first and second vibrating films 33 and 51, by applying the voice signal to the first and second coils 45 and 63 of the first and second speaker units A and B through the cable 47, and the emitted sound is transmitted to outside from the sound hole 75 of the second speaker unit B and the sound transmitting cylindrical body 73 of the cover 71.

Figure 7:
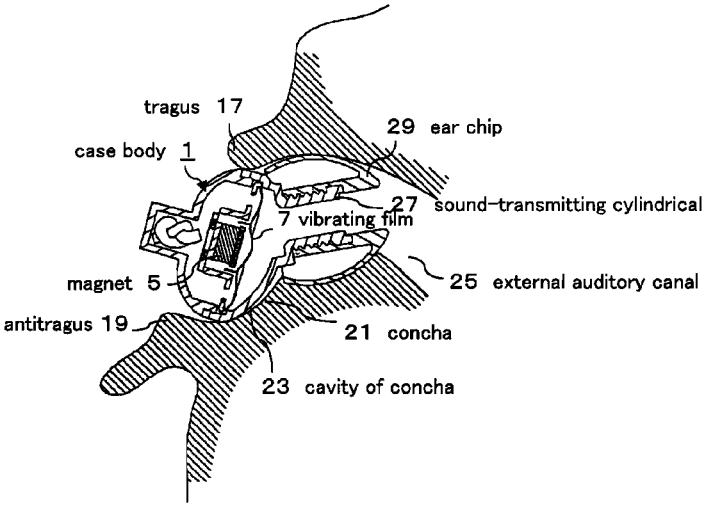
FIG. 7 is a sectional view showing the conventional earphone device along with a use example.

Then, as shown in FIG. 7, the earphone device of the present invention is configured to house the housing 69 and the cover 71 in a cavity of concha 23 surrounded by tragus 17, antitragus 19, and concha 21, and is used by inserting the tip-side ear chip 77 into an external auditory canal 25 and worn in an ear of a user.

In addition, as shown in FIG. 2, first and second coils 45 and 63 of the first and second speaker units A and B are applied with the same voice signal with phases reverse to each other, and the first and second vibrating films 33 and 51 are disposed to face each other, with a slight space between them in an airtight state. Therefore, approximately the same vibration displacement of the first and second vibrating films 33 and 51 is generated in the same direction, and a large vibration sound is generated.

In this point, in the case of the first or second speaker unit A, B as a simple body as shown in a conventional structure, when an input signal is large, an operation of the vibrating film is not a symmetric vibration in an upper (protruding) direction and in a lower (recess) direction in terms of the structure of the speaker and the shape of the vibrating film, thus easily generating a distortion at one side.

Figures 3A, 3B, 3C:
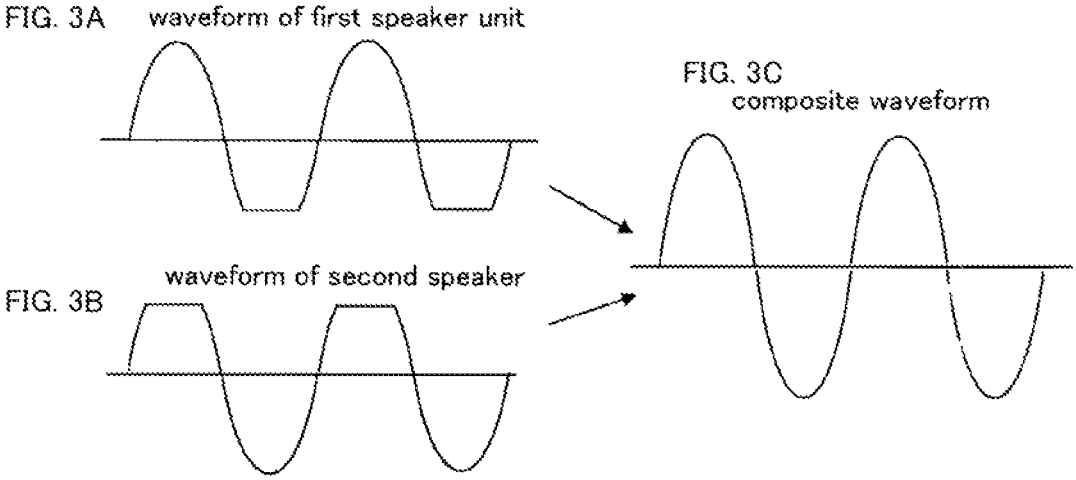
FIGS. 3A, 3B and 3C are waveform charts showing an operation of the earphone device of FIG. 1.

However, in the present invention, the abovementioned reversely faced first and second vibrating films 33 and 51 of the first and second speaker units A and B are vibrated simultaneously, with the same vibration width in the same direction, to thereby mutually complement the distortion, and as shown in a composite waveform of FIG. 3C, a composite vibration of the first and second vibrating films 33 and 51 are easily symmetric so that the distortion is reduced and the waveform becomes large.

Further, as shown in the present invention, when ends of the facing first and second magnets 37 and 55 of the first and second speaker units A and B are magnetized in the same polarity, for example in N-pole, the polarities of the ends of the first and second magnets 37 and 55 (first and second pressing plates 39 and 57) are easily repulsive each other.

Figure 4A:
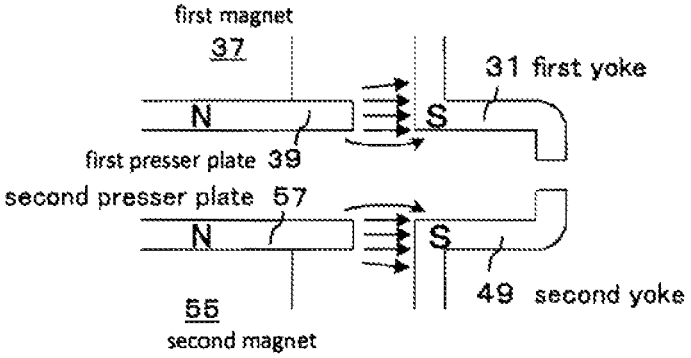
FIGS. 4A and 4B are outline views showing the operation of the earphone device of FIG. 1.

Therefore, as shown in FIG. 4A, magnetic flux generated between the end side of the first or second magnet 37, 55, and the adjacent first or second yoke 31, 49, is not expanded under an influence of the N-pole of the facing second or first yoke 49, 31. Accordingly, generation of a flux leakage between the first and second yokes 31 and 49 can be easily suppressed, and in addition, driving loss of the first and second vibrating films 33 and 51 can be reduced, because flux density is increased.

Figure 4B:
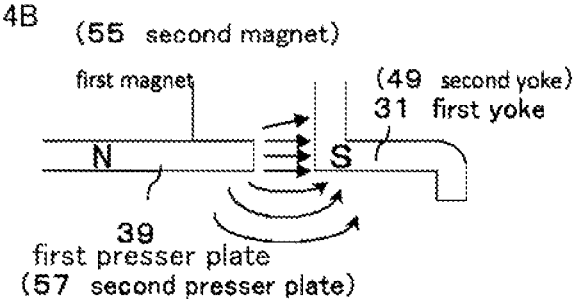
Figure 5:
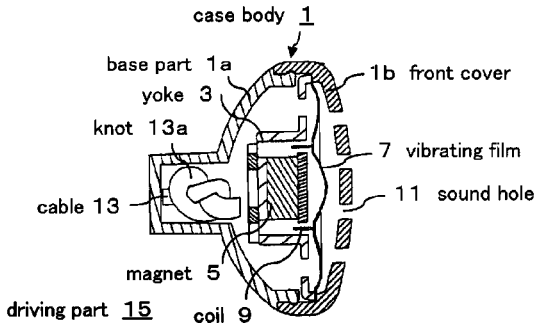
FIG. 5 is a sectional view showing a conventional earphone device.

In FIG. 4, the first and second coils 45 and 63, and the first and second vibrating films 33 and 51 are not shown.

In this point, in the first or second speaker unit A, B as a simple body as shown in the conventional structure, the magnetic flux is formed so as to be expanded to some degree between the end side of the first or second magnet 37, 55, and the first or second yoke 31, 49, thus generating the flux leakage, and it is difficult to ignore the loss.

Thus, the earphone device of the present invention includes the first speaker unit A having the first yoke 31, the first vibrating film 33 supported by the first yoke 31, and the first driving part 35 supported in the first yoke 31, for driving the first vibrating film 33 by the applied voice signal; and the second speaker unit B having the same shape as the first speaker unit A and including the second yoke 49, the second vibrating film 51 supported by the second yoke 49, and the second driving part 53 supported in the second yoke 49, for driving the second vibrating film 51 by the applied voice signal.

Further, the first speaker unit A is configured to fix the first magnet 37 in the first yoke 31 formed into a magnetic cup-shape, and fix the first vibrating film 33 to the first yoke 31 with a space between the open end face of the first yoke 31 and the first magnet 37, and insert the cylindrical first coil 45 fixed to the first vibrating film 33 into the outer periphery of the first magnet 37 with a slight space between them.

Also, the second speaker unit B is configured to fix the second magnet 55 in the second yoke 49 formed into a magnetic cup-shape, and fix the second vibrating film 51 to the second yoke 49 with a space between the open end face of the second yoke 49 and the second magnet 55, and insert the cylindrical second coil 63 fixed to the second vibrating film 51 into the outer periphery of the second magnet 37 with a slight space between them.

Further, the first and second speaker units A and B are integrally connected by the ring-shaped connecting member 67 so as to be coaxially faced in an airtight state between the first and second vibrating films 33 and 51. In addition, the first vibrating film 33 and the second vibrating film 51 are configured to be driven so as to be displaced and vibrated in the same direction.

Therefore, regarding the magnetic flux from the first and second magnets 37 and 55, the flux leakage can be significantly reduced and the flux density can be increased, and a driving force of the first and second speaker units A and B can be easily doubled.

In addition, in the first and second vibrating films 33 and 51, the distortion of odd-order can be reduced, which is possibly adversely affects a sound quality in the first and second vibrating films 33 and 51, and approximately a symmetric vibration can be easily obtained in the upper direction and in the lower direction, and a crisp driving sound with good response can be obtained, and a higher quality of the driving sound can be realized while maintaining the increase of the driving sound.

Incidentally, in the earphone device of the present invention, there may be a risk of generating a deformation in the first and second vibrating films 33 and 51 due to a pressure change of the outside air, by providing an airtight structure between the first and second vibrating films 33 and 51.

In order to respond to such a risk, a small hole (not shown) not affecting an excellent vibration frequency characteristic may be preferably formed in the first and second vibrating films 33 and 51. For example, in the case of the small hole having an inner diameter of 500 microns or less, and further preferably in the case of the small hole having an inner diameter within microns (50 to 500 microns), the frequency characteristic is hardly affected, although there is a slight change in a high sound area.

Thus, a slight change is caused in the high sound area, by forming the small hole in such a manner that it penetrates the vibrating film, so as not to affect the vibration frequency characteristic in the first and second vibrating films 33 and 51.

Therefore, in order to prevent the deformation of the first and second vibrating films 33 and 51 and control the frequency characteristic in the high sound area, for example the same or different small hole having an inner diameter of about 50 to 500 microns can be formed in one or both of the first and second vibrating films 33 and 51, thereby realizing two purposes of making the first speaker unit A in charge of a low sound, and the second speaker unit B in charge of a high sound for example.

Namely, by forming the small hole in at least one of the first and second vibrating films 33 and 51 so as not to greatly affect the frequency characteristics, the fine adjustment of the frequency characteristics of the first and second speaker units A and B is possible in a range of not significantly affecting the frequency characteristics.

Thus, in the earphone device of the present invention, the airtight state between the first and second speaker units A and B is not a complete or strict airtight state, but may be a state not affecting the vibration frequency characteristics, and if the first and second vibrating films 33 and 51 can be integrally vibrated, for example the abovementioned small hole and slight space can be formed.

Further, in the speaker for a headphone, impedance is inevitably increased, because the speaker has a large aperture, thus providing a large winding diameter of the coil and large amplitude of the speaker.

However, if such a speaker is constituted by the earphone device of the present invention, output relative to the applied voice voltage becomes large by a combination of two first and second speaker units A and B, although output relative to the voltage becomes small in the speaker as a simple body, and such a large output is advantageous auditorily and also advantageous in terms of a sound quality.

In the earphone device of the present invention, there is no necessity for forming the first and second speaker units A and B in the same shape or disposing them coaxially respectively. However, further higher quality of the driving sound is achieved by having both characteristics together by forming them in the same shape or disposing them coaxially.

Further, the earphone device of the present invention has a structure in which the open ends of the first and second yokes 31 and 49 are connected by the ring-shaped connecting member with a slight space between them, and a space between the first and second vibrating films 33 and 51 is set in an airtight state, and the first and second magnets 37 and 55 of the first and second speaker units A and B are faced each other in the same polarity. According to this structure, the first and second speaker units A and B with the same structure can be used in common, and therefore the cost is not increased and the assembly can be simplified.

Further, the earphone device of the present invention has a structure in which the first and second driving parts 35 and 53 are configured to drive the first and second vibrating films 33 and 51 by the same sound signal with phases reverse to each other, and therefore the first and second vibrating films 33 and 51 are driven so as to be displaced and vibrated in the same direction, only by the connection state of the voice signal to the first and second driving parts 35 and 53 of the first and second speaker units A and B. Therefore the structure can be simplified.

Further, the structure of the earphone device of the present invention is not limited to the structure in which the first and second speaker units A and B are formed by the first and second yokes 31 and 49, the first and second magnets 37 and 55, the first and second vibrating films 33 and 51, and the first and second coils 45 and 63. The earphone device of the present invention has the structure including the first and second yokes 31 and 49, the first and second vibrating films 33 and 51 supported by the first and second yokes 31, 49, and the first and second driving parts 35 and 53 supported in the first and second yokes 31 and 49, for driving the first and second vibrating films 33 and 51 by the applied voice signal, and also has a structure in which the first and second vibrating films 35 and 53 are driven by the first and second driving parts 35 and 53. According to this structure, the object of the present invention can be achieved.

Figure 6:
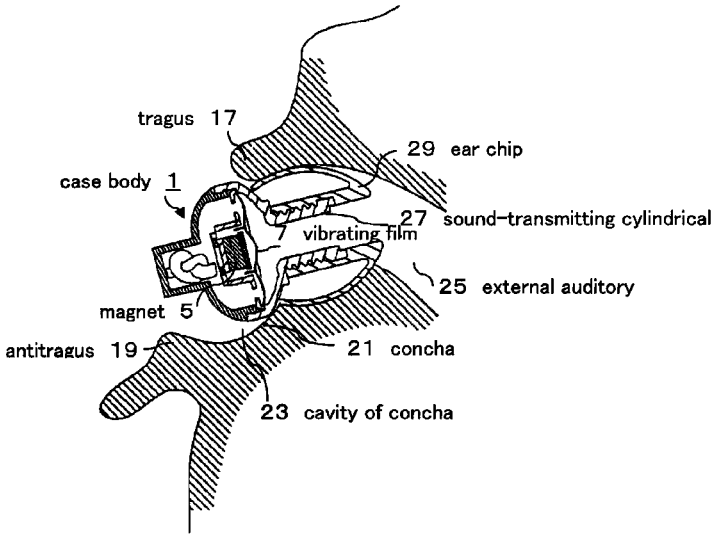
FIG. 6 is a sectional view showing the conventional earphone device along with a use example.

Further, the earphone device of the present invention can also have a structure in which the sound-transmitting cylindrical body 73 formed in the cover 71 is protruded along a central axis of the second speaker unit B, other than the structure in which the sound-transmitting cylindrical body 73 is protruded obliquely to the central axis of the second speaker unit B (see FIG. 6).

Then, the sound hole 75 formed on the second speaker unit B may be formed in either one of the first and second speaker units A and B, or either one of the first and second speaker units A and B may be disposed at the housing 69 side.

DESCRIPTION OF SIGNS AND NUMERALS

1 Case body
1*a* Base part
1*b* Front cover
3 Yoke
5 Magnet
7 Vibrating film
9 Coil
11, 75 Sound hole
13, 47, 65 Cable
13*a* Knot
15 Driving part
17 Tragus
19 Antitragus
21 Concha
23 Cavity of concha
25 External auditory canal
27,73 Sound-transmitting cylindrical body
29, 77 Ear chip
31 First yoke
33 First vibrating film
35 First driving part
37 First magnet
39 First presser plate
41 First circuit board
43 First columnar support
45 First coil
49 Second yoke
51 Second vibrating film
53 Second vibrating film
55 Second magnet
57 Second presser plate
59 Second circuit board
61 Second columnar support
63 Second coil
67 Connecting member
69 Housing
71 Cover
79 Vent hole
A First speaker unit
B Second speaker unit

The invention claimed is:

1. An earphone device, comprising:

a first speaker unit having a first yoke, a first vibrating film supported by the first yoke, and a first driving part supported in the first yoke, for driving the first vibrating film by an applied voice signal; and a second speaker unit having a second yoke, a second vibrating film supported by the second yoke, and a second driving part supported in the second yoke, for driving the second vibrating film by the applied voice signal, wherein the first and second speaker units are integrally disposed to face each other, with a space between the first and second vibrating films set in an airtight state, and the first and second vibrating films are driven so as to be displaced and vibrated in the same direction, and sound holes are formed in the first speaker unit or the second speaker unit, for transmitting the sound emitted by the vibration of the first and second vibrating films to the outside, wherein in the first speaker unit, the first yoke is formed into a magnetic cup-shape, and a first magnet is fixed in the first yoke, the first vibrating film is fixed to the first yoke with a space between the open end of the first yoke and the first magnet to cover an opening part, and a cylindrical first coil fixed to the first vibrating film is inserted into an outer periphery of the first magnet, with a slight space between them, and in the second speaker unit, the second yoke is formed into a magnetic cup-shape, and a second magnet is fixed in the second yoke, the second vibrating film is fixed to the second yoke with a space between the open end of the second yoke and the second magnet to cover an opening part, and a cylindrical first coil fixed to the second vibrating film is inserted into an outer periphery of the second magnet, with a slight space between them.

2. The earphone device according to claim 1, wherein the first and second speaker units are formed in the same shape respectively.

3. The earphone device according to claim 1, wherein the first and second speaker units are mutually disposed in a coaxial state.

4. The earphone device according to claim 1, wherein open ends of the first and second yokes are connected by a ring-shaped connecting member with a slight space between them, with the space between the first and second vibrating films set in an airtight state.

5. The earphone device according to claim 1, wherein the first and second driving parts are configured to drive the first and second vibrating films by the same sound signal with phases reverse to each other.

6. The earphone device according to claim 1, wherein the first magnet of the first speaker unit and the second magnet of the second speaker unit are faced each other in the same polarity.

7. The earphone device according to claim 1, wherein small holes are formed on at least one of the first and second vibrating films.

8. The earphone device according to claim 2, wherein the first and second speaker units are mutually disposed in a coaxial state.

9. The earphone device according to claim 2, wherein open ends of the first and second yokes are connected by a ring-shaped connecting member with a slight space between them, with the space between the first and second vibrating films set in an airtight state.

10. The earphone device according to claim 2, wherein the first and second driving parts are configured to drive the first and second vibrating films by the same sound signal with phases reverse to each other.

11. The earphone device according to claim 2, wherein small holes are formed on at least one of the first and second vibrating films.

12. An earphone device, comprising:

a first speaker unit having a first yoke, a first vibrating film supported by the first yoke, and a first driving part supported in the first yoke, for driving the first vibrating film by an applied voice signal; and a second speaker unit having a second yoke, a second vibrating film supported by the second yoke, and a second driving part supported in the second yoke, for driving the second vibrating film by the applied voice signal, wherein the first and second speaker units are integrally disposed to face each other, with a space between the first and second vibrating films set in an airtight state, and the first and second vibrating films are driven so as to be displaced and vibrated in the same direction, and sound holes are formed in the first speaker unit or the second speaker unit, for transmitting the sound emitted by the vibration of the first and second vibrating films to the outside, wherein the first and second speaker units are formed in the same shape respectively, wherein the first and second speaker units are mutually disposed in a coaxial state, wherein open ends of the first and second yokes are connected by a ring-shaped connecting member with a slight space between them, with the space between the first and second vibrating films set in an airtight state, wherein the first and second driving parts are configured to drive the first and second vibrating films by the same sound signal with phases reverse to each other, wherein in the first speaker unit, the first yoke is formed into a magnetic cup-shape, and a first magnet is fixed in the first yoke, the first vibrating film is fixed to the first yoke with a space between the open end of the first yoke and the first magnet to cover an opening part, and a cylindrical first coil fixed to the first vibrating film is inserted into an outer periphery of the first magnet, with a slight space between them, and in the second speaker unit, the second yoke is formed into a magnetic cup-shape, and a second magnet is fixed in the second yoke, the second vibrating film is fixed to the second yoke with a space between the open end of the second yoke and the second magnet to cover an opening part, and a cylindrical first coil fixed to the second vibrating film is inserted into an outer periphery of the second magnet, with a slight space between them.

13. The earphone device according to claim 12, wherein the first magnet of the first speaker unit and the second magnet of the second speaker unit are faced each other in the same polarity.

14. The earphone device according to claim 12, wherein small holes are formed on at least one of the first and second vibrating films, and wherein the first and second vibrating films have the same or different small holes having an inner diameter of 50 to 500 microns in one or both of them.

* * * * *